US008297012B2

(12) United States Patent
Nuñez-Vargas

(10) Patent No.: US 8,297,012 B2
(45) Date of Patent: Oct. 30, 2012

(54) WALL STRUCTURE WITH HOLLOW PLASTIC MODULES

(76) Inventor: Mariano Nuñez-Vargas, San Lucas (MX)

( * ) Notice: Subject to any disclaimer, the term of this patent is extended or adjusted under 35 U.S.C. 154(b) by 0 days.

(21) Appl. No.: 12/299,103

(22) PCT Filed: May 2, 2006

(86) PCT No.: PCT/MX2006/000028

§ 371 (c)(1),
(2), (4) Date: Feb. 2, 2009

(87) PCT Pub. No.: WO2007/126303

PCT Pub. Date: Nov. 8, 2007

(65) Prior Publication Data

US 2009/0301003 A1 Dec. 10, 2009

(51) Int. Cl.
*E04C 5/08* (2006.01)

(52) U.S. Cl. ..... 52/223.7; 52/561; 52/592.6; 52/606; 52/284; 52/285.1

(58) Field of Classification Search ..... 52/223.7, 52/284, 604, 592.6, 223.6, 293.3, 295, 561, 52/285.1, 285.3, 606, 582.1
See application file for complete search history.

(56) References Cited

U.S. PATENT DOCUMENTS

| | | | | |
|---|---|---|---|---|
| 2,241,169 | A * | 5/1941 | Yokes | 52/223.7 |
| 2,291,712 | A * | 8/1942 | Hatton | 52/272 |
| 2,387,659 | A * | 10/1945 | Hafsos | 52/223.7 |
| 2,684,589 | A * | 7/1954 | Perreton | 52/591.2 |
| 2,777,172 | A * | 1/1957 | Debbink | 52/582.1 |
| 2,861,388 | A * | 11/1958 | Favaretto | 446/124 |
| 2,883,852 | A * | 4/1959 | Midby | 52/236.8 |
| 3,209,510 | A * | 10/1965 | Nakanishi | 52/745.17 |
| 3,292,331 | A * | 12/1966 | Sams | 52/405.2 |
| 3,343,328 | A * | 9/1967 | Rolle | 52/605 |
| 3,382,632 | A * | 5/1968 | Grofcsik | 52/223.7 |
| 3,618,279 | A * | 11/1971 | Sease | 52/223.7 |
| 3,742,665 | A | 7/1973 | Henry et al. | |
| 5,007,218 | A * | 4/1991 | Bengtson et al. | 52/204.2 |
| 5,201,786 | A * | 4/1993 | Larsen | 52/223.7 |
| 5,471,808 | A * | 12/1995 | De Pieri et al. | 52/603 |
| 5,657,594 | A * | 8/1997 | Morita et al. | 52/249 |
| 5,678,373 | A * | 10/1997 | Franklin et al. | 52/439 |
| 5,848,927 | A * | 12/1998 | Frederiksen | 446/128 |
| 5,987,840 | A * | 11/1999 | Leppert | 52/592.6 |
| 6,161,357 | A * | 12/2000 | Altemus | 52/592.6 |
| 6,253,519 | B1 * | 7/2001 | Daniel | 52/591.1 |
| 6,282,859 | B1 * | 9/2001 | Van Der Heijden | 52/585.1 |
| 6,295,778 | B1 * | 10/2001 | Burt | 52/592.6 |
| 6,389,758 | B1 * | 5/2002 | Martin, Jr. | 52/125.2 |
| 6,571,525 | B2 * | 6/2003 | Coleman | 52/592.5 |

(Continued)

FOREIGN PATENT DOCUMENTS

FR 1586268 2/1940

(Continued)

*Primary Examiner* — Robert Canfield
*Assistant Examiner* — Babajide Demuren
(74) *Attorney, Agent, or Firm* — Roberts, Mlotkowsi, Safran & Cole, P.C.

(57) ABSTRACT

A prefabricated building module made of multiple layers of plastic blocks or hollow plastic forms aligned between upper and lower sheet steel channels which are held together with circular steel bars extending vertically between and connected to the top and bottom channels, through guide conduit orifices in the plastic blocks or the hollow plastic forms.

9 Claims, 7 Drawing Sheets

U.S. PATENT DOCUMENTS

| | | | | |
|---|---|---|---|---|
| 6,588,168 | B2 * | 7/2003 | Walters | 52/604 |
| 2003/0009963 | A1 | 1/2003 | Crowell | |
| 2003/0029119 | A1 * | 2/2003 | Coleman | 52/604 |
| 2004/0103601 | A1 * | 6/2004 | Bergqvist | 52/284 |
| 2004/0134154 | A1 * | 7/2004 | Bott | 52/604 |
| 2006/0070334 | A1 * | 4/2006 | Moser et al. | 52/592.6 |
| 2009/0113836 | A1 * | 5/2009 | Pitchers et al. | 52/604 |
| 2009/0313923 | A1 * | 12/2009 | Bucheger | 52/223.7 |

FOREIGN PATENT DOCUMENTS

| | | |
|---|---|---|
| GB | 1157682 | 7/1969 |
| WO | 2005/085544 | 9/2005 |

* cited by examiner

WALL STRUCTURE WITH HOLLOW PLASTIC MODULES

FIELD OF THE INVENTION

A lightweight, prefabricated building module made of plastic blocks or hollow plastic forms, sheet steel channels, circular steel bars, and metal or plastic mesh which can be combined into a prefabricated wall and consequentially, a house.

BACKGROUND OF THE INVENTION

In certain areas having frequent seismic activity, it would be desirable to make houses which resist such seismic activity by allowing seismic energy to dissipate without destruction of the house.

To date, there has been no full scale constructive technique in which plastic blocks or hollow plastic forms are substituted for traditional masonry in building a house.

SUMMARY OF THE INVENTION

In one embodiment the present invention is directed to a prefabricated building module made of multiple layers of plastic blocks or hollow plastic forms aligned between upper and lower sheet steel channels which are held together with circular steel bars extending vertically between and connected to the top and bottom channels, through guide conduit orifices in the plastic blocks or the hollow plastic forms.

DETAILED DESCRIPTION OF THE INVENTION

Advantageously, the prefabricated building modules of the present invention are inexpensive, lightweight and quickly assembled as compared to traditional masonry constructions, while providing excellent strength for resisting seismic disturbances, and excellent thermal and acoustic insulation. The prefabricated building modules can be used with almost any architectural or structural design, and can be used as walls, ceilings, roofs or all of the above.

Figure 1:
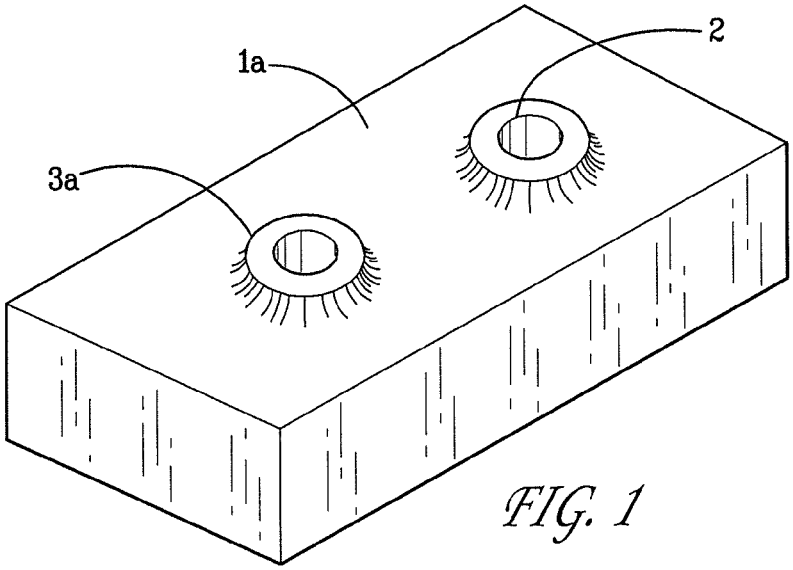
FIG. 1 is a perspective view of the plastic block according to the present invention.
Figure 3:
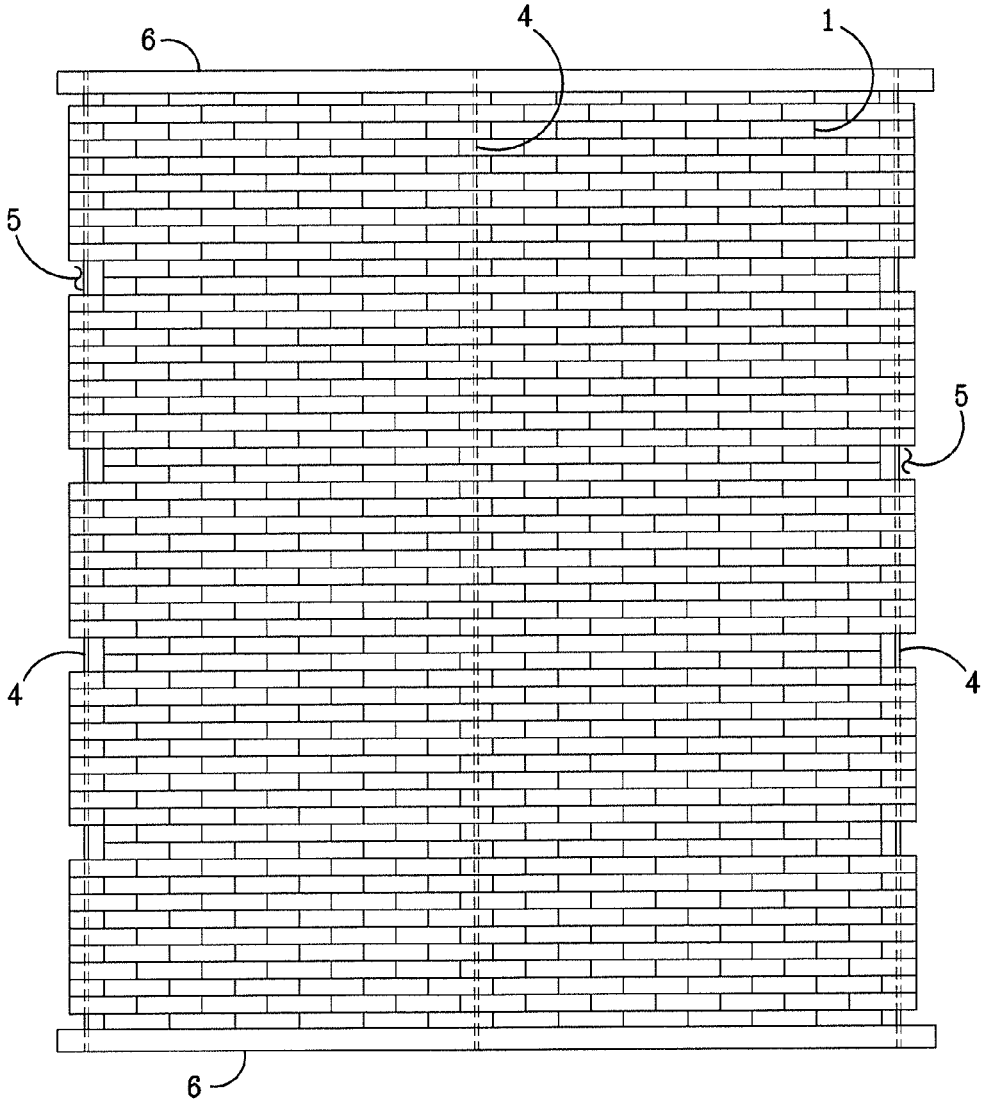
FIG. 3 is a front view of a prefabricated module with plastic blocks according to the present invention.

FIG. 1 illustrates a plastic block (1*a*) according to the present invention, which has two or more assembly posts (3*a*) disposed on the top of the block, and guide conduit orifices (2) which allow for alignment and reinforcement of the blocks with circular steel bars (4) (FIG. 3) which are slid vertically through the guide conduit orifices. The plastic block also has female openings (not shown) of the same dimensions on the underside of the block, which cooperate to snap fit with assembly posts on lower rows or layers of blocks.

Figure 2:
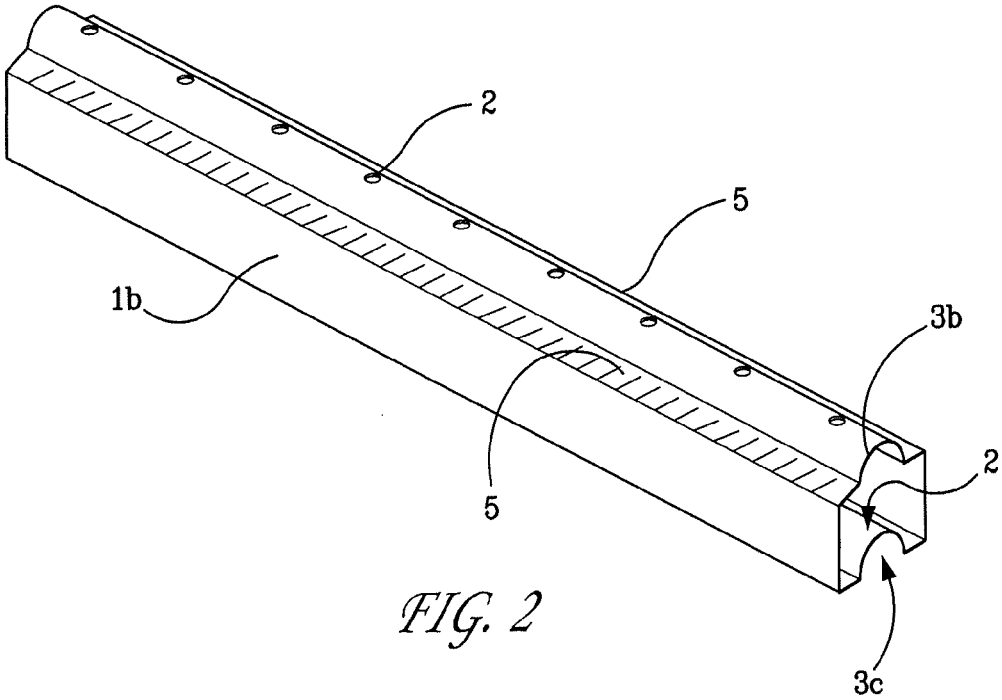
FIG. 2 is a perspective view of a hollow plastic form according to the present invention.
Figure 4:
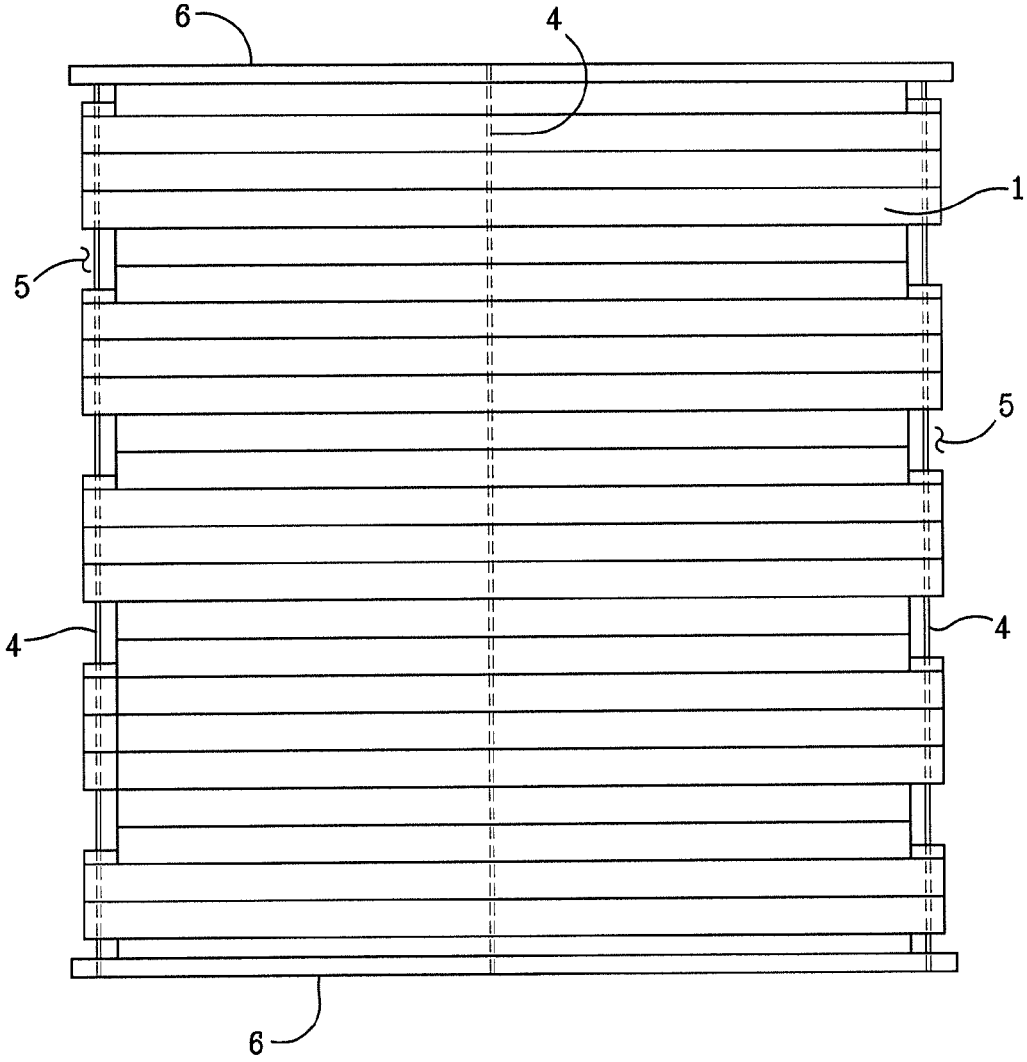
FIG. 4 presents a front view of the prefabricated module with hollow plastic forms according to the present invention.

FIG. 2 illustrates a hollow plastic form (1*b*) according to the present invention having a male protuberance (3*b*) on the top side which runs along the whole length of the form (1*b*), preferably extruded from recycled PET polymer. At the base of said form there is a female protuberance (3*c*) which cooperates with the male protuberance (3*b*) of a lower layer to snap fit. The hollow plastic form (1*b*) has two edges (5) where the base of an upper form rests once it has been assembled and to form continuous lines from bottom to top, thus forming a module (FIG. 4) for the construction of a wall. Both the male (3*b*) and female (3*c*) protuberances are interrupted by a series of guide conduit orifices (2) which cooperate to receive one or more of the circular steel reinforcement bars (4) (FIG. 4).

The prefabricated modules are made of multiple layers of plastic blocks (1*a*) (FIG. 3) or hollow plastic forms (1*b*) (FIG. 4) aligned between upper and lower sheet steel channels (6) which are held together with circular steel bars (4) extending vertically between and connected to the top and bottom channels, through the guide conduit orifices (2) in the plastic blocks or the hollow plastic forms. Intermittent spaces (5) are left which permit access to the circular steel bars (4), which are connected by means of one or more hooks (15) (FIG. 6) on either side of the prefabricated modules, making a continuity which forms walls and so on to form buildings.

The bottom channel (6) serves as a base for building using the plastic building blocks (1*a*) or hollow plastic forms (1*b*), by placing subsequent rows or layers, one on top of another indefinitely until the desired height is reached. When this is achieved, the layers are held together with circular steel bars (4) which are slid vertically through the guide conduit orifices (2) and into contact with the bottom channel (6).

Subsequently, another sheet steel channel (6) is placed upside-down over the top layer of blocks or hollow plastic forms making contact with the circular steel bars, and the circular steel bars on the ends of the module are soldered to the lower upper steel channels, thus creating a resistant frame.

One or more intermediate circular steel bars may be placed which slide through the guide conduit orifices (2) in the plastic blocks or hollow plastic forms. These additional steel bars are placed freely (i.e. not connected) to the inside surfaces of the lower and upper sheet steel channels. Preferably, said additional circular steel bars are placed at distances of between 80 and 120 cm, depending on the length of the module and respond to seismic movements, if need be, serving as an element which dissipates seismic energy by freely sliding in both the horizontal and vertical directions due to the fact that they are restrained by the upper and lower sheet steel channels. These intermediate circular steel bars act as a support element which resists gravitational pull, while not presenting significant lateral deformation, being confined within the guide conduit orifices (2) in the plastic blocks or hollow plastic forms. Once assembled, a module is formed which makes up a resistant wall and thus building houses using a new constructive system.

Figure 5:
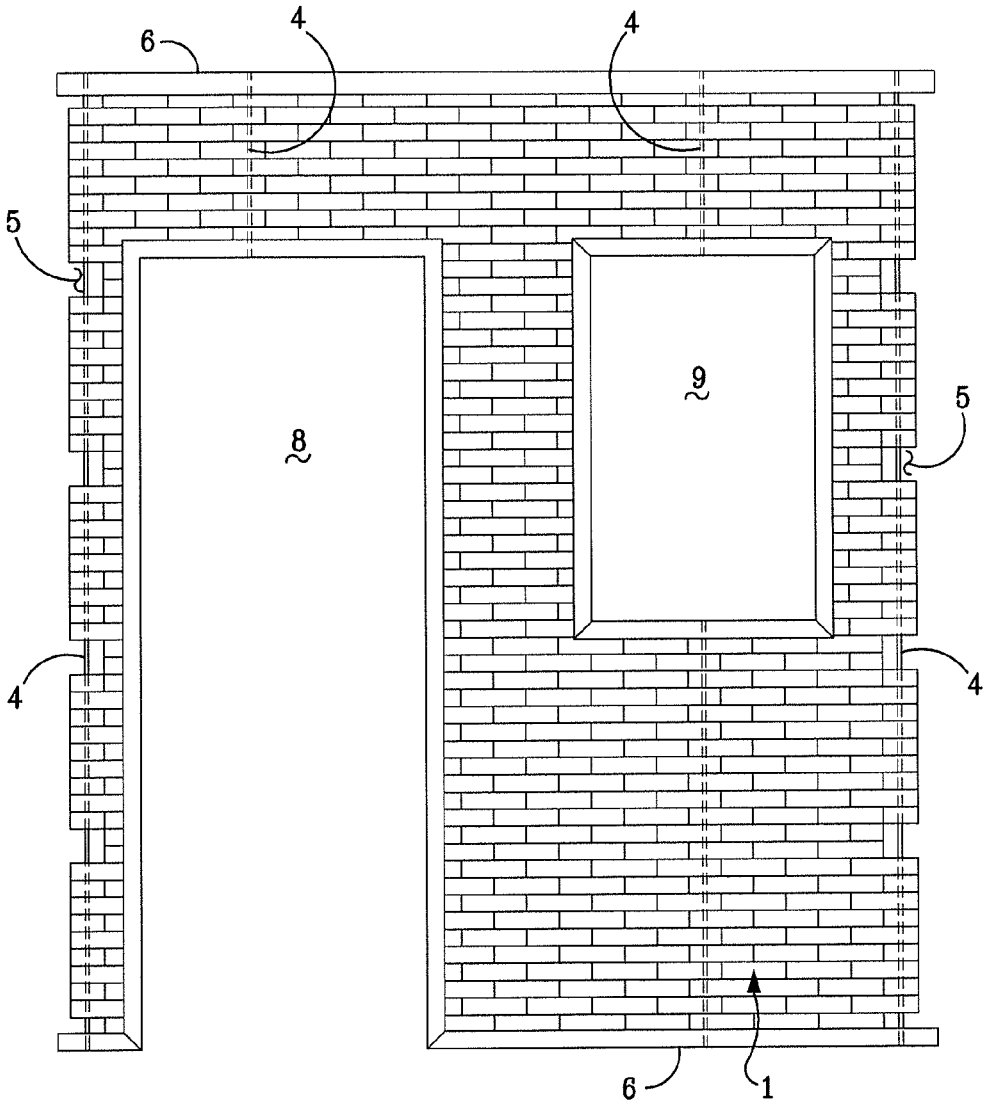
FIG. 5 is a front view of the prefabricated module of the present invention which includes a doorframe and a window frame.

The modules may be prefabricated according to any type of defined architectural project and can be provided with doorframes (8) (FIG. 5) and window frames (9) made of integrated sheet steel channels. To manufacture a module which includes doorframes (8) and/or window frames (9), the necessary space is left depending on the size of the door and/or the size of the window thus forming part of the module which in turn gives rise to a wall with doors and windows.

Figure 6:
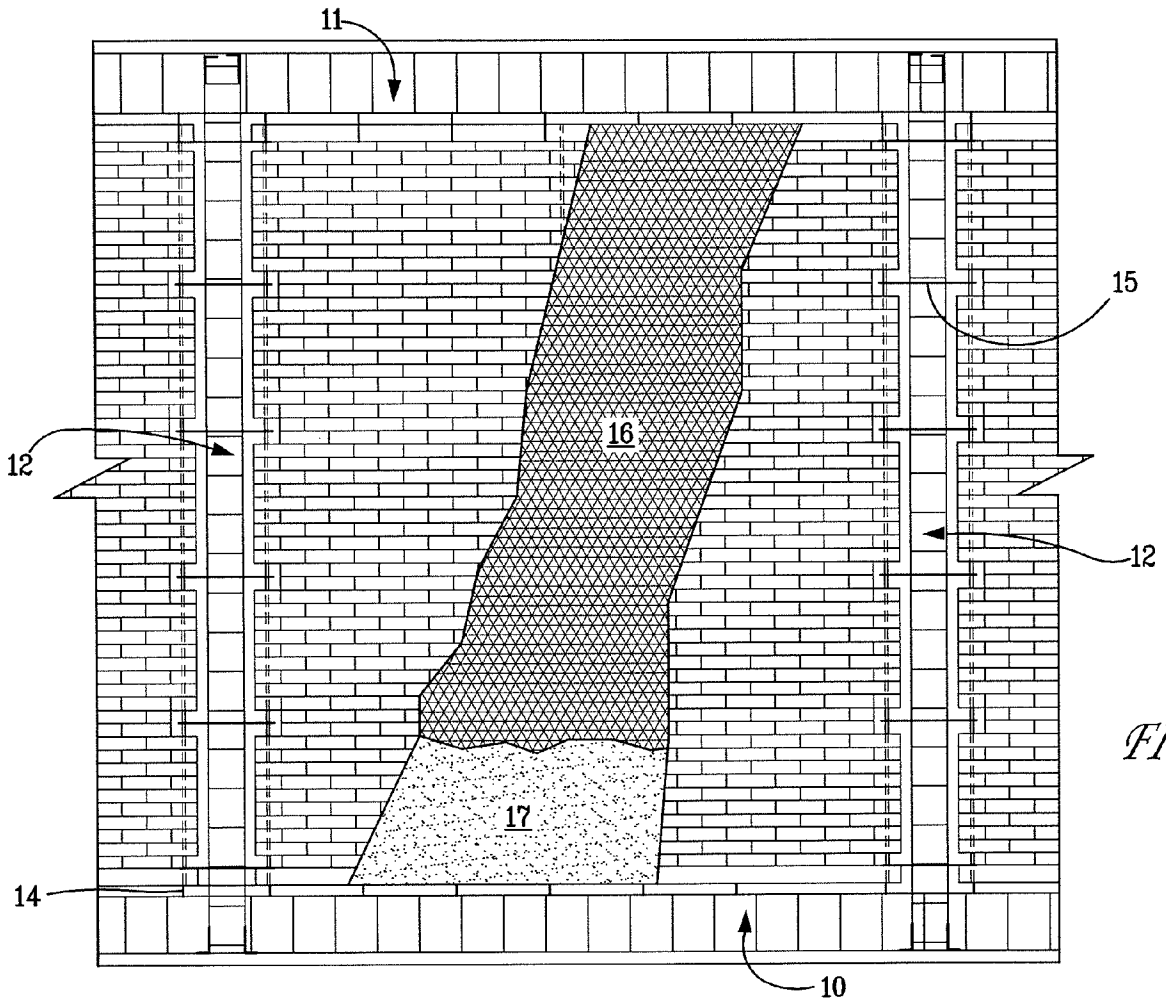
FIG. 6 is a front view of the complete structural system according to the present invention.

Said prefabricated modules can be connected to a prefabricated rectangular armex base of U bricks (10) as illustrated in FIG. 6, or a reinforced steel structure made of four horizontal steel bars, which in the four corners are supported by abutments made of rolled wire and connected at the ends to vertical columns (12), manufactured in the same way as the U block of the base. The interconnection is made using hooks (15) made of rolled wire attaching one end of each module to the other, said hooks being prefabricated onto the circular steel bars (4).

Columns (12) rest on a foundation which is connected to the lower U block base, into which the prefabricated modules are placed, so that later an upper U block enclosure (11) may be placed on the prefabricated module, thus forming a resistant structural frame and consequently giving rise to this new system of construction which may be used in any kind of building.

Finally, mesh (16) is placed to form a soffit along the width and length of both faces of the wall, the objective of which is to assure the adherence of mortar (17) made of cement, lime and sand to the wall. Once hardened, the mortar mixture on both faces of the wall gives rigidity to the structural system and allows for any type of floor or mezzanine system to be used.

Additionally, U-shaped hooks (14) are used as the connecting agents between the prefabricated modules and the lower U block base (10) and upper U block enclosure (11), as well as the rolled wire hooks (15) to connect to the circular steel bars (4) at the ends of the two modules.

Figure 7:
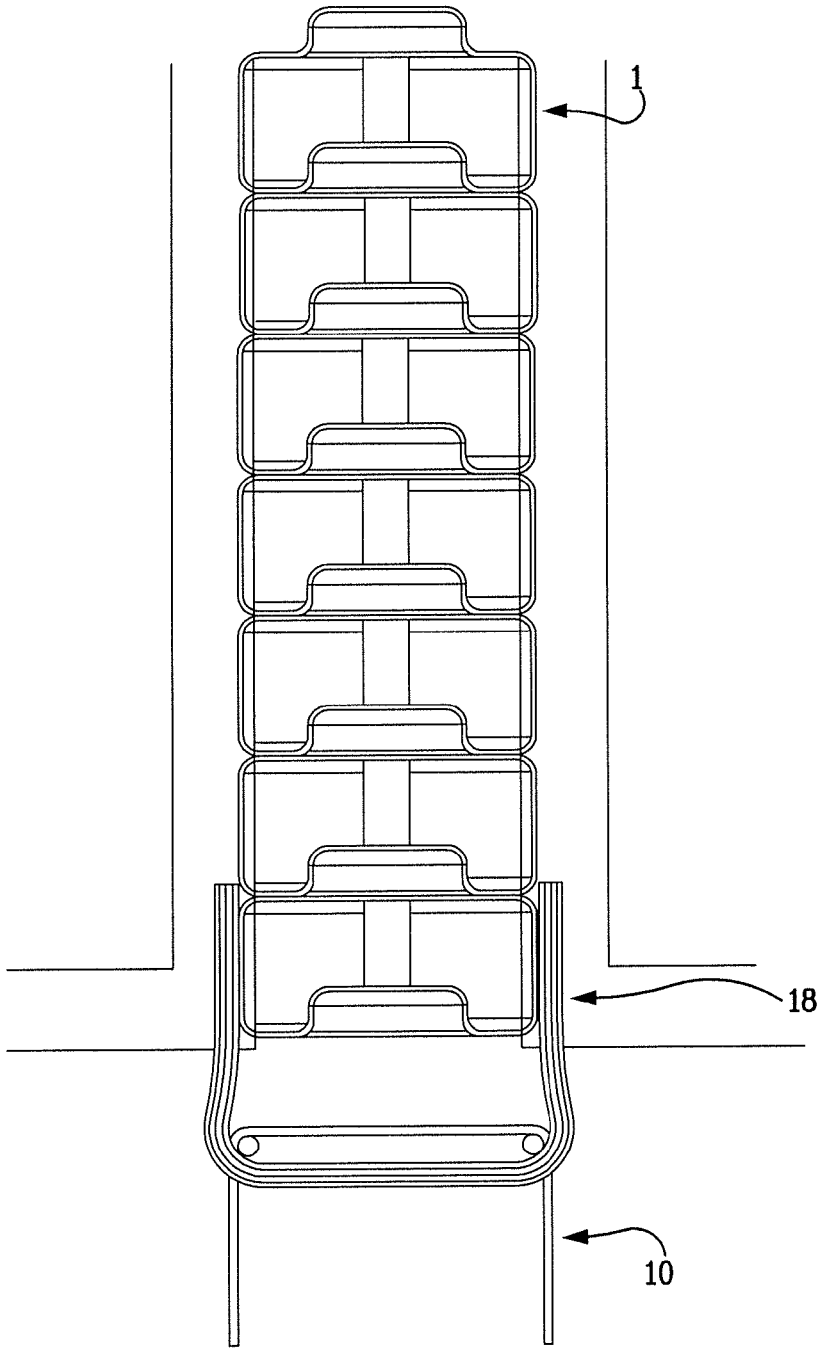
FIG. 7 is a detailed view of the connection between the lower U block base and the prefabricated module of the present invention.

FIG. 7 illustrates details of the soldered connection between the lower U block base (10) and the prefabricated module by means of U-shaped elements (18) made of rolled wire, the ends of which are soldered to the lower sheet steel channel.

Figure 8:
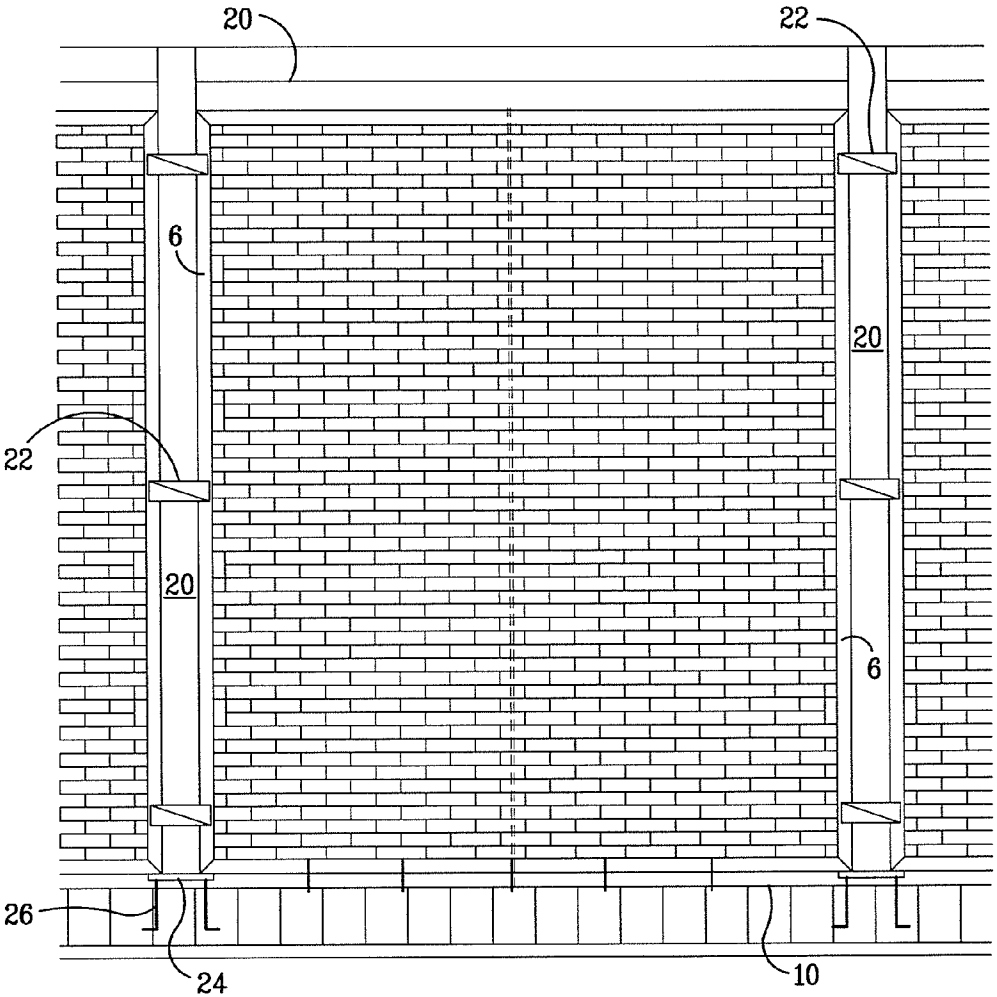
FIG. 8 is a front view of an alternative structural system according to the present invention.

FIG. 8 presents a front view of an alternative structural system in which in place of columns, rectangular sections of steel called PTR (20) are used to house the prefabricated modules. Onto said prefabricated modules, at their side edges, vertical sheet steel channels (6) which encircle the plastic blocks or hollow plastic forms are added, thus creating a closed frame in interaction with the lower and upper steel channels which in turn interact with the rectangular sections of PTR (20). Assembly connecting is based on sections of sheet steel (22) which are soldered or screwed to lateral sections of vertical PTR steel and so on until they are connected to the upper horizontal element of the PTR steel rectangular section and the prefabricated module. The vertical elements of rectangular sections of steel which substitute for the columns are anchored by means of a base plaque (24) on the lower end, which in turn has screw grooved openings which allow for the passage of threaded rods (26) anchored in the concrete of the lower U block base (10). A nut is attached to said threaded rod (26) in order to insure the verticality of the rectangular section of steel PTR.

In an advantageous embodiment, during construction on any of the sides of the module is connected a metal or wooden formwork which can contain a concrete mixture and thus when the metal or wooden formwork is removed, a rigid structure which will resist gravitational and lateral forces remains. Once this phase of the walls is completed, metal (chicken wire type metal) or plastic mesh (16) is placed on both faces in order to assure the adherence of the mortar (17) which will later harden in order to give the building the necessary consistency and rigidity.

This system of construction is a constructive alternative which substitutes traditional masonry bricks in the construction of houses, giving mankind an ecological opportunity to avoid solid residues and creating a culture of recycling, since stockpiled recovered plastic bottles can be used.

Having sufficiently described the invention, it is considered an innovation and as such we claim as property that which is expressed and contained in the following claim clauses.

Having sufficiently described the invention, it is considered an innovation and as such we claim as property that which is expressed and contained in the following claim clauses:

1. A building module, comprising upper and lower sheet steel channels having disposed therebetween a plurality of layers of interconnecting plastic blocks or hollow plastic forms, the bottom and top layers of which fit into the channels of said sheet steel channels, said plastic blocks or hollow plastic forms having vertically aligning guide conduit orifices therethrough, and at least two circular steel bars disposed vertically through said guide conduits at either end of the module and soldered to said upper and lower sheet steel channels, wherein each hollow plastic form is an elongate form having corresponding and similarly dimensioned U-shaped male and female protuberances running the length of top and bottom sides of the form, which cooperate to interconnect said hollow plastic forms by snapping the male U-shaped protuberance of a lower form into the female U-shaped protuberance of an upper form, wherein said module has one or more intermittent spaces at either end of one or more of said layers exposing one or more portions of said circular steel bars.

2. The building module of claim 1, wherein each plastic block comprises corresponding and similarly dimensioned assembly posts and female openings on its top and bottom sides respectively, which cooperate to interconnect said blocks by snapping the assembly posts of a lower block into the female openings of an upper block.

3. The building module of claim 1, wherein the guide conduit orifices are formed within the boundaries of said assembly posts and said female openings.

4. The building module of claim 1, wherein the lengths of said protuberances are interrupted by a plurality of said guide conduit orifices which are vertically aligned from the top protuberance to the bottom protuberance.

5. The building module of claim 1, wherein the plastic is polyethylene terephthalate.

6. The building module of claim 1, further comprising one or more additional circular steel bars disposed vertically through said guide conduits intermediate the ends of the module, but not connected to said upper and lower sheet steel channels.

7. The building module of claim 1, further comprising left and right sheet steel channels at either end of said module and connecting to said upper and lower sheet steel channels.

8. A building wall comprising:

(a) two or more connected building modules, each module comprising upper and lower sheet steel channels having disposed therebetween a plurality of layers of interconnecting plastic blocks or hollow plastic forms, the bottom and top layers of which fit into the channels of said sheet steel channels, said plastic blocks or hollow plastic forms having vertically aligning guide conduit orifices therethrough, and at least two circular steel bars disposed vertically through said guide conduits at either end of and connected to said upper and lower sheet steel channels;

(b) vertical columns made of concrete or steel separating and attached to left and right ends of said building modules at said circular steel bars; and (c) an inverted U-block base for said building modules, wherein said building modules are connected to said inverted U-block base with a series of U-shaped rolled wire elements extending through said inverted U-block base, the ends of which U-shaped rolled wire elements are soldered to either side of said lower sheet steel channels, and said vertical columns are connected to said inverted U-block base.

9. The building wall of claim 8, further comprising a finishing mesh made of steel or plastic disposed on the outside of said wall for supporting finishing mortar or stucco.

* * * * *